United States Patent [19]

Mauldin

[11] 4,332,505

[45] Jun. 1, 1982

[54] PAVER ATTACHMENT

[76] Inventor: Herbert N. Mauldin, Rte. 7, Viewmont Dr., Greenville, S.C. 29609

[21] Appl. No.: 236,284

[22] Filed: Feb. 19, 1981

[51] Int. Cl.[3] ..... E01C 19/18

[52] U.S. Cl. ..... 404/108

[58] Field of Search ..... 404/105, 108, 101, 84; 198/312; 414/523

[56] References Cited

U.S. PATENT DOCUMENTS

| | | | |
|---|---|---|---|
| 710,611 | 10/1902 | Ray | 414/523 X |
| 3,292,804 | 12/1966 | Veneman | 414/523 X |
| 3,473,679 | 10/1969 | Weichel | 414/523 X |
| 3,540,359 | 11/1970 | Swisher | 414/523 X |
| 3,967,912 | 7/1976 | Parker | 404/84 |
| 3,997,277 | 12/1976 | Swisher | 404/84 |
| 4,253,612 | 3/1981 | Schulze | 414/523 X |

*Primary Examiner*—Nile C. Byers, Jr.

*Attorney, Agent, or Firm*—Bailey & Hardaway

[57] ABSTRACT

A unitary flight chain assembly for a paver is illustrated as having mounting structure for removably positioning same upon a support structure carried beneath the hopper of the paver, and removable covers are provided to facilitate lifting the flight chain assembly out of the paver and for replacement thereof.

2 Claims, 5 Drawing Figures

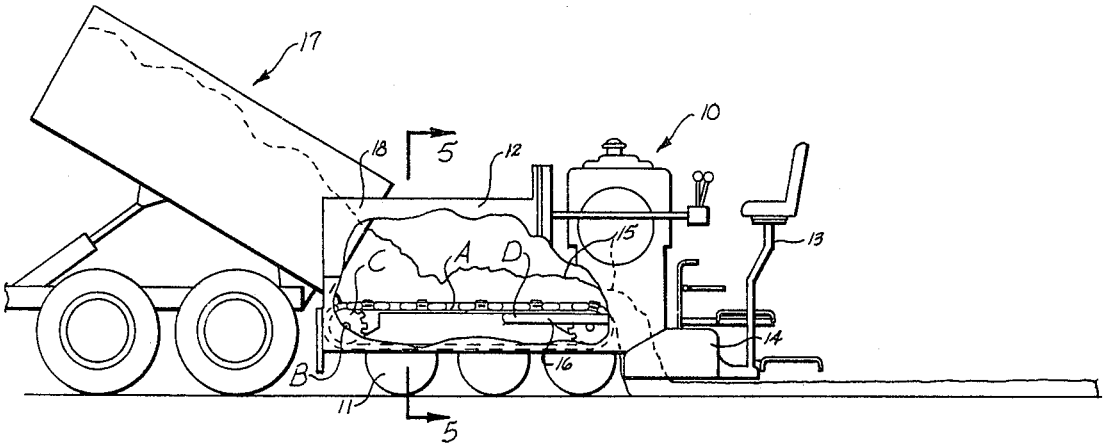
Fig. 1
Fig. 2
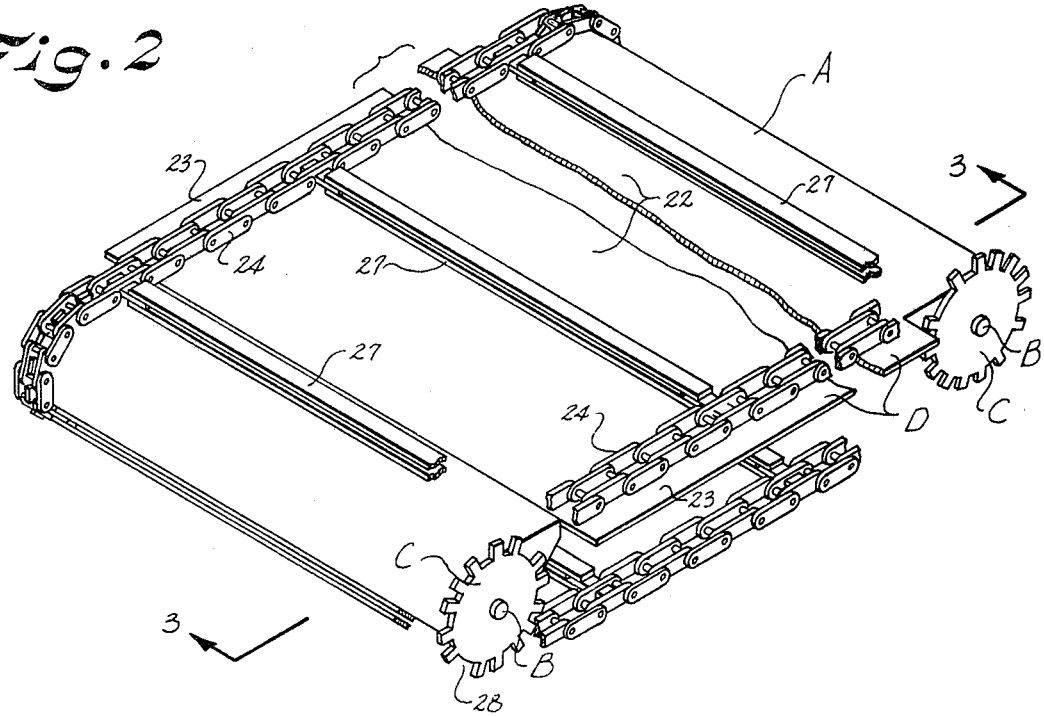
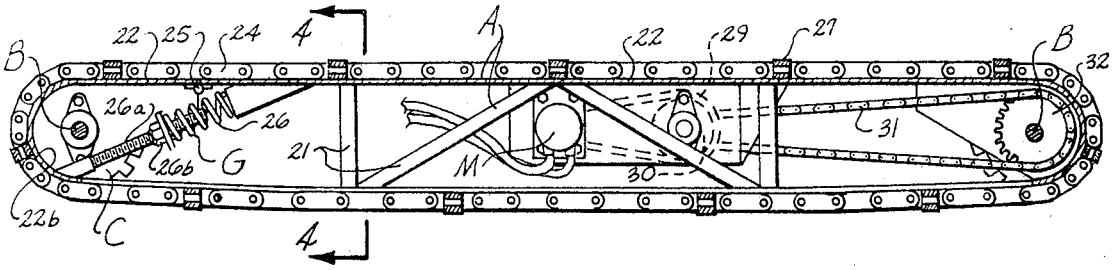
Fig. 3

PAVER ATTACHMENT

BACKGROUND OF THE INVENTION

Pavers as constructed in accordance with the prior art utilize flight chains having transverse bars for conveying asphalt from the hopper rearwardly often for side delivery by means of augers for carrying the asphalt towards each side of the paver for delivery and subsequent spreading through the use of a screed bar and the like. The flight chains constructed in accordance with the prior art were of the type which is permanently fixed beneath a central opening in the hopper, with the bottom of the hopper extending partially across the flight chain to avoid the asphalt pouring out around the sides of the flight chain assembly. The mounting of the flight chain assembly, together with the extension of the bottom of the hopper partially thereacross, necessitates bringing the entire paver back to the shop and turning same upsidedown to gain access to the flight chain assembly. Since the flight chain is subject to relatively frequent breakdowns due to damage through excessive asphalt buildups and the like, the requirement for returning the paver to the shop and the prodigious efforts necessary to effect repairs, results in expensive machine downtime.

Accordingly, it is an important object of the present invention to provide a paver having a flight chain assembly and hopper mounting such that the flight chain assembly may be removed from the paver as a unit for facilitating repair through the expedient of utilizing removable hopper flaps which replace the portion of the hopper bottom which extends across the flight chain in prior art pavers.

Another important object of the invention is to provide unitary flight chain assemblies which are removably mounted beneath the hopper so that they may be removed as a unitary member for repair and temporarily replaced with a spare assembly so that machine down time may be further reduced.

SUMMARY OF THE INVENTION

It has been found that a paver may be provided with a unitary flight chain assembly, useful with a hopper having removable plate covers for overlying the unitary flight chain assembly while permitting removal thereof as a unitary member. The flight chain assembly comprises a unitary frame which carries chain carrying and driving means adjacent each end thereof. Preferably, driving means may further include a motor, or at least a power takeoff device, carried by the unitary assembly. Also, resilient means are provided for yieldably tensioning the flight chain so that chunks of asphalt, as may be built up and then further dislodged and other foreign objects may be permitted to pass without so excessively tensioning the chains as to cause breakage.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a side elevation illustrating a paver of the self-propelled type receiving asphalt from a dump truck within the hopper and being conveyed rearwardly for delivery in any suitable fashion such as by augers, not shown, for side delivery with treatment by a screed bar, FIG. 2 is an enlarged perspective view illustrating a flight chain assembly constructed in accordance with the present invention with parts omitted, and parts broken away for clarity of illustration, FIG. 3 is a longitudinal, sectional elevation taken on the line 3—3 in FIG. 2 illustrating yieldable resilient means for tensioning the chains, as well as a suitable drive therefor, as carried within the assembly.

DESCRIPTION OF A PREFERRED EMBODIMENT

The drawings illustrate a paver having a hopper and means for feeding asphalt and the like rearwardly of the hopper by a flight chain assembly having transverse flight bars between spaced drive chains for delivery from the paver. The assembly includes a unitary frame A for carrying said flight chain. A pair of longitudinally spaced shafts B are carried adjacent end portions of the frame. A sprocket C is carried by each end of the shafts engaging the spaced drive chains for carrying a flight chain. Means D removably position the frame and the flight chain carried thereby within the hopper. Removable covers E are carried by the hopper partially overlying the flight chain on each side thereof. Means F are provided for driving the flight chain. Resilient means G are provided for yieldably tensioning the flight chain.

While the invention is described utilizing a paver of the self-propelled variety, it is to be understood that other pavers employing hoppers and providing flight chains with bars for rearward feeding of asphalt received in the hopper are useful for practice of the invention.

Figure 4:
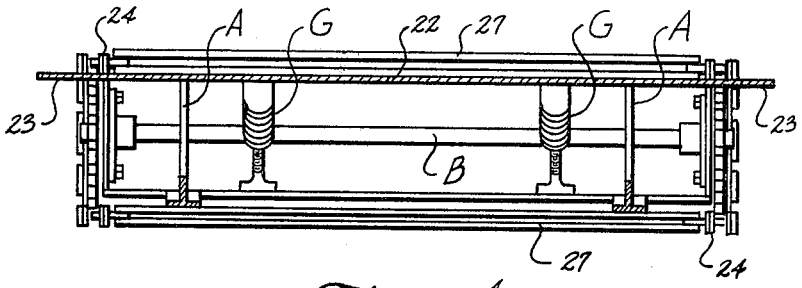
FIG. 4 is a transverse sectional view taken on the line 4—4 in FIG. 3.
Figure 5:
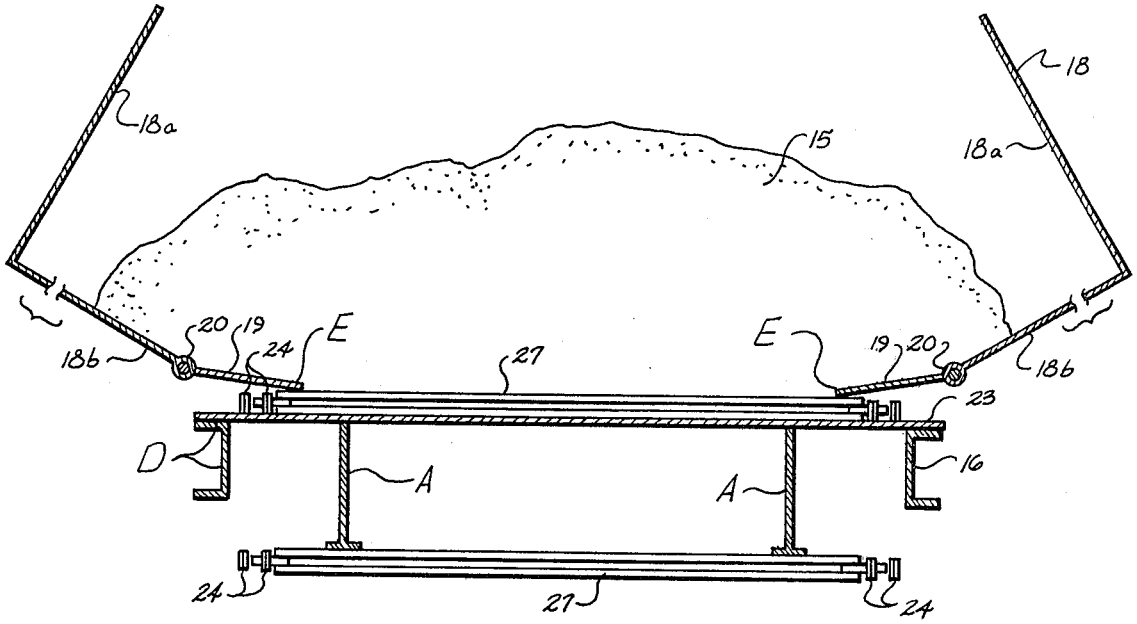
FIG. 5 is an enlarged transverse, sectional elevation taken on the line 5—5 in FIG. 1.

Referring more particularly to FIG. 1, a paver of the self-propelled variety is broadly designated at 10 and has suitable wheels 11 with a suitable chassis for carrying the body 12 and driver's seat 13. A screed is schematically illustrated at 14 for spreading the asphalt which is illustrated at 15 in FIGS. 1 and 5. The chassis includes longitudinal supports illustrated as channel members 16 in FIGS. 1 and 5. A dump truck is broadly designated at 17 in FIG. 1 for delivering the asphalt to the hopper 18. The hopper 18 is further illustrated in FIG. 5 as having side members **18*a* and a generally inwardly extending bottom 18*b*. The inward edges of the bottom have covers or plates 19 which are hinged as at 20 to the free edges of the bottom members 18*b*. The covers 19 are removable by pivoting them upwardly so that they overlie the bottom portions 18*b* to provide clear access for the flight chain assembly for removal and replacement thereof. The flight chain assembly includes a unitary frame member which comprises a frame portion 21, together with an upper plate 22** comprising a portion of a unitary frame A for carrying the flight chain which underlies the upper flight of the flight chains and provides the mounting for a pair of longitudinally spaced shafts B. The shafts B may each be provided in the form of a stub shaft on each side or any suitable equivalent structure for the chain carrying sprockets C.

Means D are provided for removably positioning the frame and the flight chain assembly within the hopper which includes laterally extending tab members 23 on each side, as well as longitudinal rails such as the channels illustrated at 16. The unitary assembly is thus suspended by the tabs 23, which are carried upon the longitudinal rails 16.

One end of the frame A includes hinged plate portions **22*a* illustrated as carrying a downwardly extending arcuate forward portion 22*b* about which the transversely spaced chains 24 pass. The hinged members 25 permit downward pivoting of the forward member 22*b* thereabout against the force of the compression spring 26. The compression spring 26 forming a part of the resilient means designated at G tensions the chains by an outward thrust against the forward member 22*b*. A threadable member 26*a* provides an adjustable support for the spring 26 which passes thereabout through the use of the threadable adjusting member 26*b***.

Removable covers E may be provided in the form of plates 19 which have been previously described as being pivoted at 20, and the covers E extend inwardly overlying the edges of the flight chain assembly to facilitate removal of the flight chain assembly for repair and for replacement of same. It will be observed that the members E overlie the flight bars 27 which are spaced and extend transversely so as to be carried between the chains. It will be observed that some of the sprocket teeth are omitted, or at least the spacing is increased as illustrated at 28 in FIG. 2, so as to permit passage of the flight bars thereabout.

Suitable means are provided for driving the flight chain, which includes a suitable motor M, illustrated in FIG. 3 with a suitable drive 29 for driving a sprocket 30 for providing a suitable power takeoff or transmission such as gearing, not shown, from which a drive chain 31 transmits power to a sprocket 32 which, in turn, drives one of the shafts B imparting a driving force to the flight chains.

It is thus seen that a paver accommodating a unitary flight chain assembly has been provided wherein the unitary assembly may be removed for repair and servicing, minimizing down time of the paver. The paving operation is considerably facilitated because of the removal of a major cause of machine down time. Repair may be readily carried out when the unitary flight chain may be positioned in a convenient location for repair rather than having workmen relegated to the confines of the inverted paver and hopper.

While a preferred embodiment of the invention has been described using specific terms, such description is for illustrative puuposes only, and it is to be understood that changes and variations may be made without departing from the spirit or scope of the following claims.

What is claimed is:

1. A paver having a hopper and means for feeding asphalt and the like rearwardly of the hopper by a flight chain assembly having transverse flight bars between spaced drive chains comprising:

a unitary frame carrying said flight chain;

a pair of longitudinally spaced shafts carried adjacent end portions of said frame;

a sprocket carried by each end of said shafts engaging said spaced drive chains for carrying said flight chain;

means removably positioning said frame and the flight chain carried thereby within the hopper;

removable covers carried by said hopper partially overlying said flight chain on each side thereof; and means for driving said flight chain.

2. The structure set forth in claim 1 including resilient means yieldably tensioning said flight chain.

* * * * *